US007035578B1

(12) United States Patent
Young

(10) Patent No.: US 7,035,578 B1
(45) Date of Patent: Apr. 25, 2006

(54) IMAGE SHIFTING IN A DIGITAL PRINTER TO REDUCE IMAGE ARTIFACTS

(75) Inventor: Timothy J. Young, Williamson, NY (US)

(73) Assignee: Eastman Kodak Company, Rochester, NY (US)

( * ) Notice: Subject to any disclaimer, the term of this patent is extended or adjusted under 35 U.S.C. 154(b) by 29 days.

(21) Appl. No.: 10/782,438

(22) Filed: Feb. 19, 2004

Related U.S. Application Data

(60) Provisional application No. 60/458,330, filed on Mar. 28, 2003.

(51) Int. Cl.
*G03G 15/20* (2006.01)

(52) U.S. Cl. ..... 399/322

(58) Field of Classification Search ..... 399/322, 399/328, 68
See application file for complete search history.

(56) References Cited

U.S. PATENT DOCUMENTS 4,870,445 A * 9/1989 Collier et al. ..... 399/325
5,289,247 A * 2/1994 Takano et al. ..... 399/68
5,322,273 A 6/1994 Rapkin et al.
6,190,771 B1 2/2001 Chen et al.
6,229,972 B1 * 5/2001 Rushing ..... 399/74
6,295,424 B1 9/2001 Regelsberger et al.
6,517,346 B1 2/2003 Chen et al.
6,842,592 B1 * 1/2005 Kinoshita ..... 399/69

FOREIGN PATENT DOCUMENTS

JP 07199694 * 8/1995

* cited by examiner

*Primary Examiner*—Quana M. Grainger
(74) *Attorney, Agent, or Firm*—Donna P. Suchy

(57) ABSTRACT

A printing machine (10) is disclosed in which printing is effected by toner being transferred from a photoconductor (18) to a receiver sheet (S) at a transfer station (46). A fuser (49) is also provided to fuse the transferred toner to the receiver sheet (S). A preferred fuser includes a heated fuser roller (70) that receives a film of a release oil (73). As a given number of supply of a receiver medium (e.g., paper) of a common size are printed and fused, the cross-track position (XTSP) at which the paper is positioned at the fuser roller (70) varies. This eliminates the release oil (73) from building up on the fuser roller (70) and transferring to subsequent larger receiver sheets (S), and reduces non-uniform wear on rollers at the fuser (49), thus reducing likelihood of image artifacts and machine contamination.

25 Claims, 6 Drawing Sheets

IMAGE SHIFTING IN A DIGITAL PRINTER TO REDUCE IMAGE ARTIFACTS

CROSS-REFERENCE TO RELATED APPLICATIONS

This application claims the benefit of U.S. Provisional Patent Application Ser. No. 60/458,330 filed Mar. 28, 2003.

STATEMENT REGARDING FEDERALLY SPONSORED RESEARCH OR DEVELOPMENT

Not applicable.

BACKGROUND OF THE INVENTION

This invention is in the field of digital printing, and is more specifically directed to image formation in electrophotographic printing.

Electrographic printing has become a prevalent technology in the modern computer-driven printing of text and images, on a wide variety of hard copy media. This technology is also referred to as electrographic marking, electrostatographic printing or marking, and electrophotographic printing or marking. Conventional electrographic printers are well suited for high resolution and high speed printing, with resolutions of 600 dpi (dots per inch) and higher becoming available even at modest prices. At these resolutions, modern electrographic printers and copiers are well-suited to be digitally controlled and driven, and are thus highly compatible with computer graphics and imaging. Examples of conventional printing machines with this capability include the DIGIMASTER 9110 network imaging system and the DIGIMASTER 9150i digital press, both available from Heidelberg USA, Inc.

A typical electrographic printer includes a primary image forming photoconductor, which may be a moving belt in large scale printers, or a rotating drum in smaller laser printers and photocopiers. The photoconductor is initially sensitized or conditioned by the application of a uniform electrostatic charge at a primary charging station in the printer. An exposure station forms an image on the sensitized photoconductor by selectively exposing it with light according to the image or text to be printed. The exposure station may be implemented as a laser, an array of light emitting diodes (LEDs), or a spatial light modulator. In modern electrographic printing, a computer typically drives the exposure station in a raster scan manner according to a bit map of the image to be printed. The exposing light discharges selected pixel locations of the photoconductor, so that the pattern of localized voltages across the photoconductor corresponds to the image to be printed.

At a developing or toning station in the typical electrographic printer, a developer roller or brush is biased to a bias voltage roughly at the primary charging voltage of the sensitized photoconductor prior to exposure. The biased developer roller or brush is loaded with toner, which is typically a mixture of a fine metallic powder with polyester resin and powdered dye, charged to the bias voltage. As the exposed photoconductor passes the developing station, toner is attracted to the discharged pixel locations of the photoconductor. As a result, a pattern of toner corresponding to the image to be printed appears on the photoconductor. This pattern of toner is then transferred to the medium (e.g., paper) at a transfer station. The transfer station charges the medium to an opposing voltage, so that the toner on the photoconductor is attracted to the medium as it is placed in proximity to the photoconductor.

The transferred toner is not permanently fixed to the medium at the transfer station, however. Conventional electrographic printers have a fusing, or fixing, station located downstream from the transfer station, at which the transferred toner pattern is fused to the medium. Conventional fusing stations apply heat and pressure to fuse the transferred toner to the medium, after which it travels to a finishing station in the printer for collating, sorting, stapling or other binding, and other finishing operations.

In order to permanently fix or fuse the toner material onto the medium using heat, the temperature of the toner material is elevated to a point at which constituents of the toner material coalesce and become tacky. This action causes the toner to flow to some extent into the fibers or pores of the receiving medium. The toner material then solidifies as it cools, bonding firmly to the receiving medium.

One approach to the thermal fusing of toner is to pass the receiver with its electrostatically adhered toner images between a pair of opposed rollers, at least one of which is heated. In a fusing system of this type, the receiving medium passes through a nip formed at the contact location between the opposed rollers, typically with the side of the medium having the toner pattern contacting the heated fuser roller. The toner pattern is thus heated by the roller as the medium passes within the nip. In typical conventional fusing stations, the fusing roller (i.e., the roller contacting the toner side of the medium) is coated with an silicon rubber or other low surface energy elastomer.

Because the toner pattern is made tacky by heat, though, there is a tendency for toner to be retained by the heated fuser roller, rather than penetrate into the receiver medium. If this occurs, the retained toner can transfer to the next receiver sheet as it is fused. This retained toner could also transfer to the opposed pressure roller while no sheets are passing through the fusing station. In either case, so-called "offset" image artifacts, as referred to in the copying art, can be formed on subsequent sheets.

To address this problem, a thin layer of a toner release agent, for example a silicone oil (e.g., polydimethylsiloxane), is applied to the fuser roller to form an interface between the roller surface and the toner pattern on the imaged medium, and act as a polymeric release agent. The relatively low surface energy of this low viscosity oil enables release of the fuser roller from the tackified toner, and from the receiver medium to which the toner pattern is bonded as it passes through the roller nip. This clean release prevents the toner from offsetting to the surface of the fuser roller. Typically, the release oil is applied to the surface of the fuser roller by a donor roller that is coated with oil provided by a supply sump. Examples of roller-based fusing stations utilizing a toner release oil applied by a donor roller are described in U.S. Pat. No. 6,190,771 and U.S. Pat. No. 6,517,346 B1, both incorporated herein by this reference.

In conventional printing machines, as evident from the above description, the release oil is applied over the entire surface of the roller, regardless of the size of the paper or other medium that is being printed. The release oil is effectively cleaned from the fuser roller by the medium itself as it passes through the roller nip, to the extent of the area of the fuser roller that contacts the medium. It has been observed, however, that excess release oil will tend to build up on the fuser roller at those regions that are outside of the paper contact area.

Modern printing machines are capable of printing on a wide range of paper sizes. It has been observed, however, in connection with this invention, that if a significant release oil buildup occurs after the printing of relatively small page sizes, the subsequent printing of larger sized media will cause some of the built-up release oil to be transferred from the fuser roller to sheets of the larger media. The presence of this release oil on the larger media will appear as an image artifact.

In addition, this oil residue has a tendency to attract other contaminants, such as paper fibers, dust, and the like, that are present in the printing machine. This effect is especially a problem in printers having a duplex mode, where the printed (on one side) sheet returns to the transfer and fusing stations to receive a printed image on its other side. It has been observed, according to this invention, that fuser release oil residue on a sheet that is returned to the transfer station will convey these contaminants to the transfer station. These transferred contaminants not only result in additional image artifacts on subsequent sheets, but can also eventually foul the interior of the entire printing machine.

Other image artifacts caused at the fuser roller have also been observed. "Step-and-groove" artifacts are wear-related artifacts, caused by wear of the fuser roller by its repeated fusing of a large number of sheets of one media size (e.g., 8½" by 11" paper or transparencies); the subsequent printing of larger media after such wear can result in visible artifacts on the larger media, at locations corresponding to the edges of the worn spots on the fuser roller. Another type of wear-related image artifact is due to wear of a glossy finish roller, which is provided at or after the fuser to impart a glossy finish on selected receiver media. Repeated use of the glossy finish roller for a large number of sheets of one size of media can unevenly wear this roller, causing the glossy finish to be non-uniform when larger media sizes are then printed and fused with a glossy finish.

BRIEF SUMMARY OF THE INVENTION

It is therefore an object of this invention to provide a printing machine and method of operating the same in which the buildup of release oil from the fusing station is minimized.

It is a further object of this invention to provide such a machine and method in which a wide variety of media sizes can be accommodated while preventing the release oil buildup.

It is a further object of this invention to provide such a machine and method in which other wear-related image artifacts caused at the fuser station are reduced.

It is a further object of this invention to provide such a machine and method that can be efficiently retrofitted into existing printing machines.

Other objects and advantages of this invention will be apparent to those of ordinary skill in the art having reference to the following specification together with its drawings.

The present invention may be implemented in a digital printing machine having a track width, corresponding to the photoconductor, the transfer station, and the fusing station, that is larger than the dimension of the printed media and image in at least some cases. According to this invention, the cross-track position at which the receiving medium contacts the fuser roller is varied. This may also require varying the cross-track position of the photoconductor at which images are formed at the marking engine, corresponding to the position of the media at the fuser roller. The varying can be done from sheet to sheet, or periodically (after a selected number of sheets in one position). By varying the cross-track position of the media at the fuser roller, release oils tend not to build up on the fuser roller, and wear of the fuser roller itself, and of other rollers such as those used to form a glossy finish, can be made more uniform, reducing image artifacts upon the printing of larger media sizes.

DETAILED DESCRIPTION OF THE INVENTION

The preferred embodiment of this invention will now be described in connection with its preferred embodiment. In this example, the preferred embodiment of the invention is an electrographic printer, considering that this invention is contemplated to be particularly beneficial in such an application. It will be appreciated by those skilled in the art having reference to this specification that this invention can also be used in any type of electrographic system, of any size or capacity. As such, this description is provided by way of example only, and is not intended or contemplated to limit the true scope of the invention as claimed.

Figure 1:
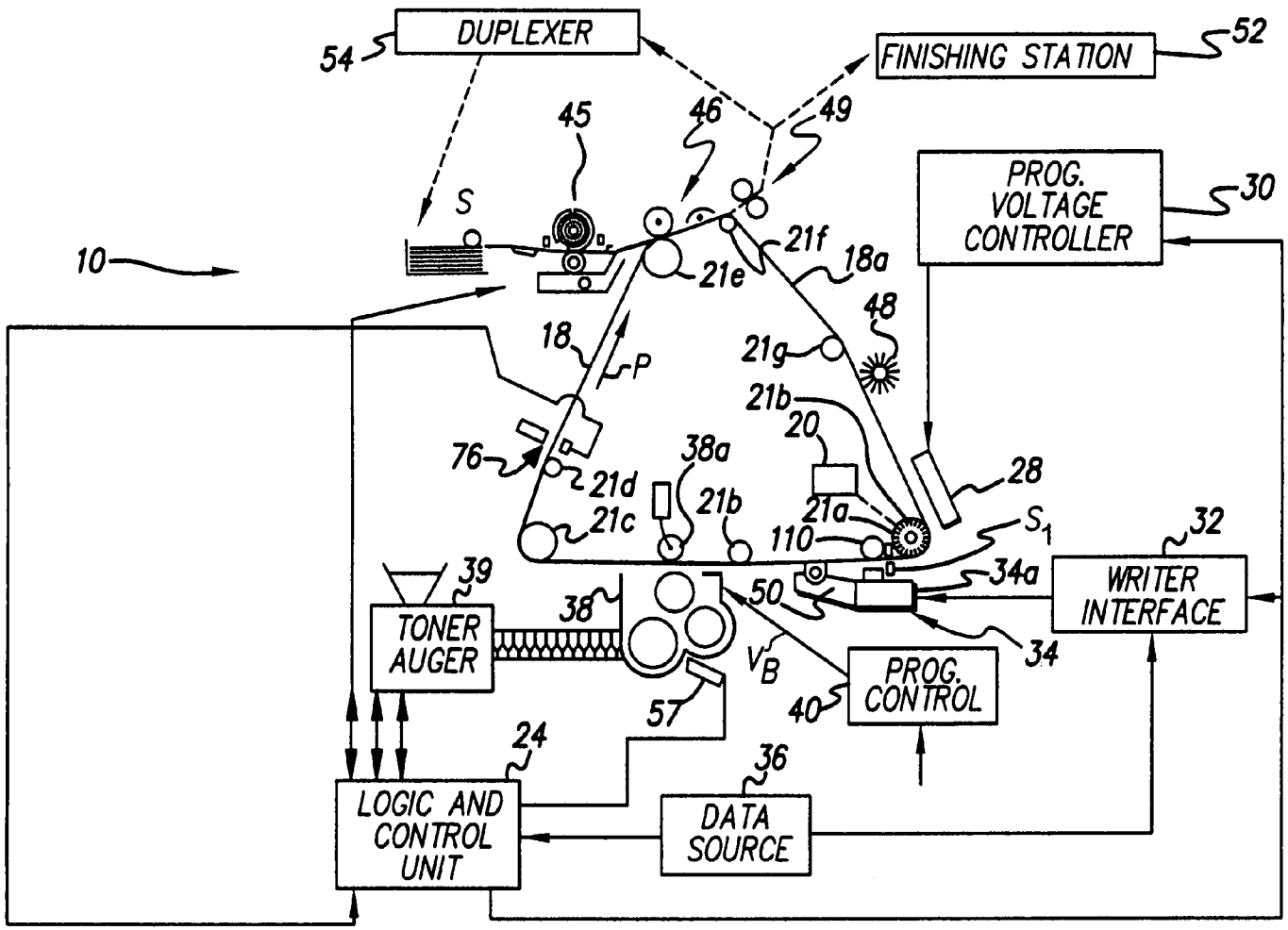
FIG. 1 is a schematic diagram, in block form, of a printing machine constructed according to the preferred embodiment of the invention.

Referring now to FIG. 1, printer machine 10 according to the preferred embodiment of the invention will now be described. In electrographic printer machine 10 of FIG. 1, a moving recording member such as a photoconductive film belt 18 is entrained about a plurality of rollers or other supports 21*a* through 21*g*, one or more of which is driven by a motor to advance the belt. By way of example, roller 21*a* is illustrated as being driven by motor 20. Motor 20 preferably advances the belt at a high speed, such as 20 inches per second or higher, in the direction indicated by arrow P, past a series of workstations of the printer machine 10. Alternatively, photoconductor 18 may be wrapped and secured about only a single drum. Still further in the alternative, photoconductor 18 may be implemented by way of a drum having a photoconductive surface.

Printer machine 10 includes logic and control unit (LCU) 24, preferably a digital computer or microprocessor operating according to a stored program for sequentially actuating the workstations within printer machine 10, effecting overall control of printer machine 10 and its various subsystems. LCU 24 also is programmed to provide closed-loop process control of printer machine 10 in response to signals from various sensors and encoders, in the conventional manner. In this manner, LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such from as a human user or a network control. The output data and control signals from LCU 24 are applied directly or through storage latches to suitable output drivers and in turn to the appropriate subsystems within printing machine 10.

Primary charging station 28 in printer machine 10 sensitizes photoconductor 18 by applying a uniform electrostatic corona charge, from high-voltage charging wires at a predetermined primary voltage to surface 18*a* of photoconductor 18. Other forms of chargers, including brush or roller chargers, may also be used. This operation prepares a portion of photoconductor 18 for receipt of image information, which in this case is applied by exposure station 34 selectively discharging of locations of photoconductor 18.

At exposure station 34, writer 34*a* projects light in a selected pattern to photoconductor 18. This light selectively dissipates the electrostatic charge on photoconductive photoconductor 18 to form a latent electrostatic image of the document to be copied or printed. Writer 34*a* is preferably constructed as an array of light emitting diodes (LEDs), or alternatively as another light source such as a laser or spatial light modulator. In any case, writer 34*a* exposes individual picture elements (pixels) of photoconductor 18 with light at a regulated intensity and exposure. According to this embodiment of the invention, image data to be printed is provided to writer 34*a* by data source 36 via writer interface 32. Data source 36 is contemplated to be a computer or microcontroller, itself storing a bit map for the image in its own memory or receiving the bit map over a data network. The pattern of the image to be formed is applied to writer interface 32, along with control signals from logic and control unit 24 that indicate the position of photoconductor 18 at which this image is to be formed.

According to this embodiment of the invention, the charge pattern formed on photoconductor 18 by writer 34*a* corresponds to the size of the media on which the corresponding image is to be transferred, and at a selected position on photoconductor 18, both in an "in-track" direction and a "cross-track" direction. The in-track position of the image on photoconductor 18 is generally defined by frame areas on photoconductor 18. Typically, the entire length of photoconductor 18 is divided into frames, each frame carrying a single page image. The in-track position of an image within the frame typically has a fixed starting position, regardless of the size of the image media.

Figure 2:
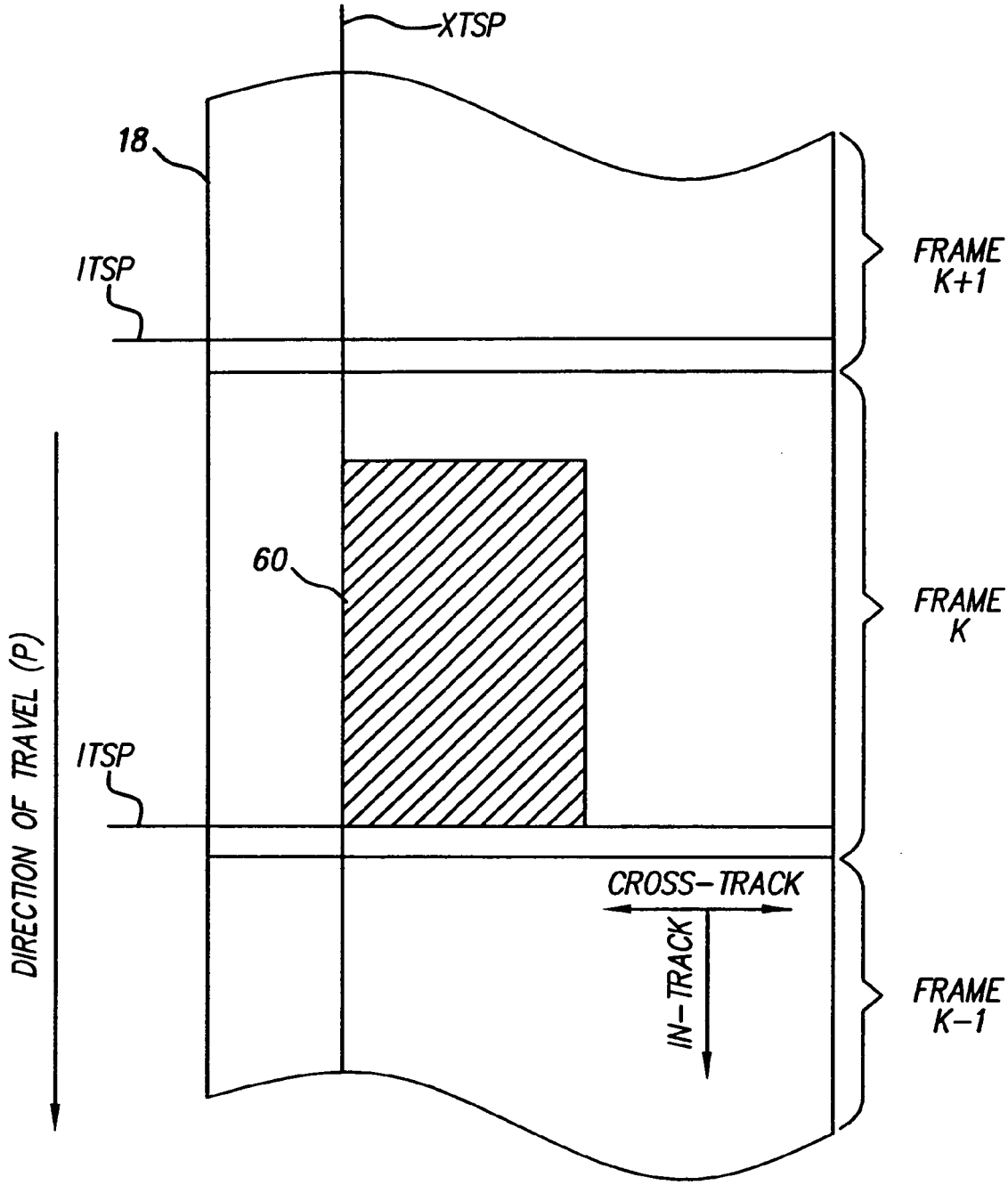
FIG. 2 is a view of a portion of a photoconductor as used in the printing machine of FIG. 1 according to the preferred embodiment of the invention.

FIG. 2 illustrates an example of the defining of the placement of images on photoconductor 18. Typically, photoconductor 18 is significantly wider than that of a typical sheet of media to be printed, as shown in FIG. 2, relative to the example of image area 60. Three frame areas k−1, k, and k+2 of photoconductor 18 are illustrated in FIG. 2, following one another in sequence along the direction of travel (i.e., the "in-track" direction) as shown.

As shown in FIG. 2, image area 60 is illustrated in its location within frame k. The leading (in the direction of travel) edge of image area 60 is at in-track starting point ITSP. The left edge of image area 60 is positioned at cross-track starting point XTSP, also as shown in FIG. 2. Image area 60 corresponds to the size of the media sheet upon which an image is currently being printed by printer machine 10, and as such is the area in which writer 34*a* can affect the charge pattern on photoconductor 18 for that image. Typically, the leading edge in-track starting point ITSP is constant, relative to the frame area, regardless of the media sheet size, but of course the length of image area 60 from starting point ITSP will vary with the media size. In conventional printers, the cross-track position of image area 60 will vary with media size. In addition, according to the preferred embodiment of the invention, the cross-track position of image area 60 and specifically the cross-track starting point XTSP, will vary among the printing run even if the media size does not change.

Referring back to FIG. 1, after exposure of image area 60, the portion of photoconductor 18 bearing the latent charge images travels to development station 38. As conventional in the art, in this example, development station 38 includes a magnetic brush in juxtaposition to, but spaced from, the travel path of photoconductor 18. Alternatively, other known types of development stations or devices may be used, or plural development stations 38 may be provided for developing images in plural colors, or using toners having different physical characteristics.

Upon the imaged portion of photoconductor 18 reaching development station 38, LCU 24 selectively activates development station 38 to apply toner to photoconductor 18. Preferably, this activation is effected by LCU 24 controlling a mechanism to move backup roller 38*a*, and thus photoconductor 18, into engagement with or close proximity to the magnetic brush. Alternatively, the magnetic brush may be moved toward photoconductor 18 to selectively engage photoconductor 18. In either case, charged toner particles on the magnetic brush are selectively attracted to the latent image patterns present on photoconductor 18, developing those image patterns. As known in the art, conductor portions of development station 38, such as conductive applicator cylinders, are biased to act as electrodes. Examples of the developer mix used at development station include a two-component mix having a dry mixture of toner and carrier particles; alternatively, a single component developer or a conventional liquid toner may be used. Toner is supplied to development station 38 by motor-driven toner auger 39, under the control of LCU 24.

Registration station 45 and transfer station 46 in printing machine 10 move receiver sheet S into engagement with photoconductor 18, in registration with a developed image in a frame of photoconductor 18, to transfer the developed image to receiver sheet S. Receiver sheets S may be plain or coated paper, plastic, transparency material, or another medium capable of being printed upon by printer machine 10. Typically, transfer station 46 includes a charging device for electrostatically biasing movement of the toner particles from photoconductor 18 to receiver sheet S. In this example, the biasing device is roller 46*b*, which engages the back of sheet S and which is connected to programmable voltage controller 46*a* that operates in a constant current mode during transfer. Alternatively, an intermediate member may have the image transferred to it and the image may then be transferred to receiver sheet S.

Registration station 45 controls the positioning of receiver sheets S at transfer station 46, so that each receiver sheet S reaches transfer station 46 in registration with a corresponding developed image on photoconductor 18. This registration includes registration in the in-track and cross-track directions, and also includes the correction of skew of the receiver sheets S relative to the desired path of travel. An example of the construction and operation of registration station 45, as suitable for use in connection with printing machine 10 according to the preferred embodiment of the invention, is described in U.S. Pat. No. 5,322,273, incorporated herein by this reference.

Cleaning station 48, such as a brush, blade, or web as is well known, is also located behind transfer station 46, and removes residual toner from photoconductor 18. A pre-clean charger (not shown) may be located before or at cleaning station 48 to assist in this cleaning. After cleaning, this portion of photoconductor 18 is then ready for recharging and re-exposure. Of course, other portions of photoconductor 18 are simultaneously located at the various workstations of printing machine 10, so that the printing process is carried out in a substantially continuous manner.

After leaving transfer station 46, receiver sheet S is detacked from photoconductor 18. At this point, receiver sheet S is carrying a pattern of toner corresponding to the image to be printed as defined by the charge pattern written at exposure station 34. This toner is not yet fused to receiver sheet S at this point, but electrostatically adheres to receiver sheet S. Receiver sheet S then travels to fusing station (fuser) 49 where the image is fixed to sheet S. After fusing at fuser 49, receiver sheet S then passes to finishing station 52 for collating, sorting, stapling, or the like, or alternatively passes to duplexer 54 if the opposite side of receiver sheet S is also to be printed.

Figure 3:
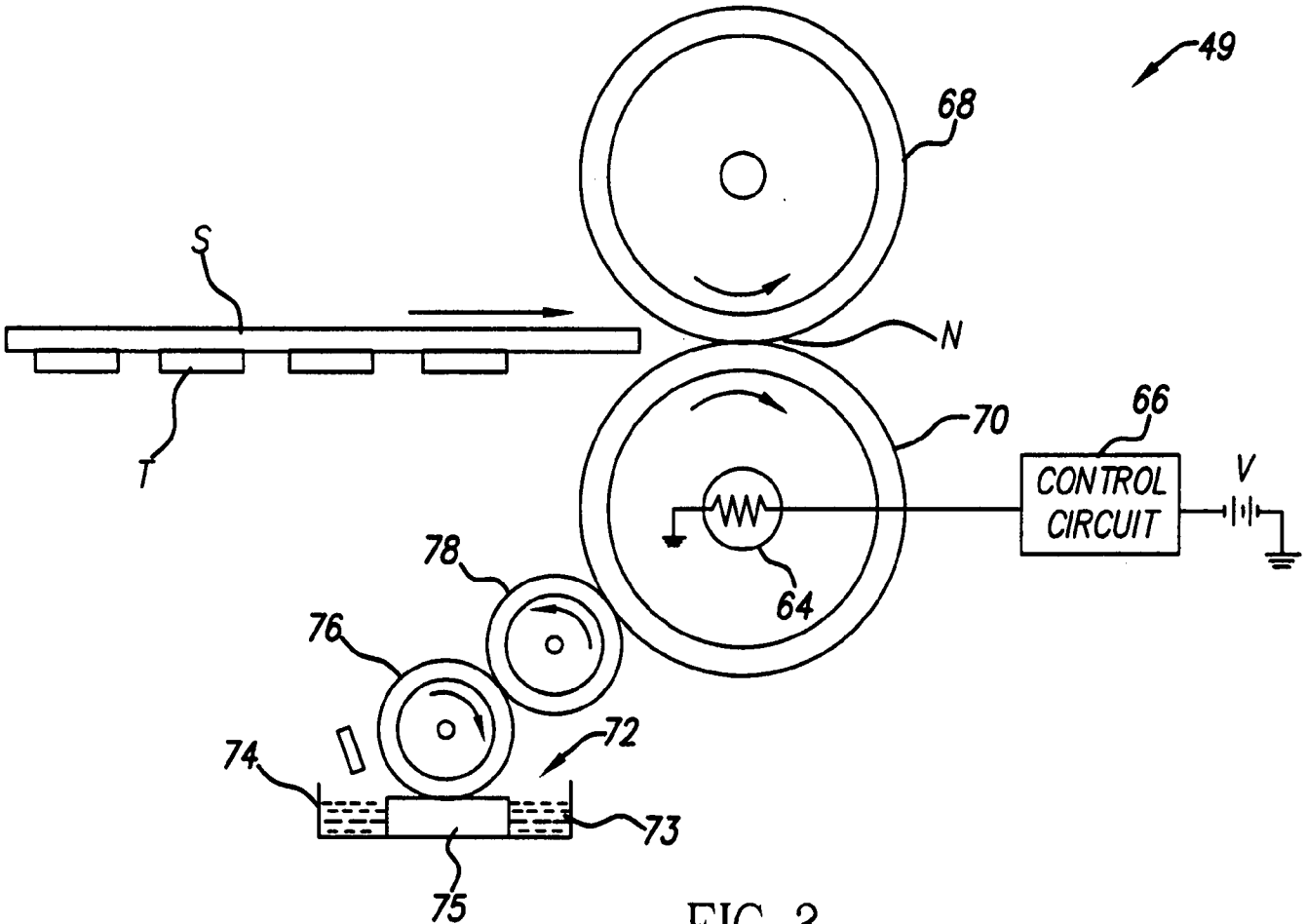
FIG. 3 is a schematic diagram of a fuser in the printing machine of FIG. 1 according to the preferred embodiment of the invention.

Referring now to FIG. 3, an example of fuser 49 according to the preferred embodiment of the invention will now be described. In this exemplary embodiment, fuser 49 includes fuser roller 70 and an elastomeric pressure roller 68 that together define nip N. Fuser roller 70 can be made of or have an outer surface including an elastomer, either silicone or fluoropolymer based. The particulate imaging material, or toner, T disposed on receiver sheet S is fused into receiver sheet S at nip N by the application of heat and pressure. In this example, heat is provided by heating lamp 64, which may be a resistive lamp within fuser roller 70 that is controlled by control circuit 66. Alternatively or in addition, fuser roller 70 can be externally heated by a heated roller that rides along its surface. Further in the alternative, some types of toner T are fusable into receiver sheet S by pressure, without heat.

In this example, reservoir 74 provides a supply of polymeric release agent or oil 73, for example a silicone oil (e.g., a polydimethylsiloxane). Wicking device 72, in the form of wick 75, absorbs release oil 73 and is contacted by metering roller 76. Donor roller 78 is disposed intermediately between fuser roller 70 and metering roller 76, and transfers release oil 73 to fuser roller 70, as a continuous supply. Donor roller 78 may, for example, be formed of a shaft with a solid or hollow cylindrical shaft, coated with a conformable material. Typically, fuser roller 70, pressure roller 68, and donor roller 78, are from about 12 to 18 inches in width (i.e., width being in parallel to the major axis of the cylinders).

Release oil 73 that is applied to fuser roller 70 ensures that toner T from receiver sheet S does not adhere to the surface of fuser roller 70, but instead remains fused to receiver sheet S as it leaves fuser 49. As mentioned above, release oil 73 preferably has a relatively low surface energy. In practice, a thin layer of release oil 73 at the surface of heated fuser roller 70 forms an interface between the surface of fuser roller 70 and toner T carried on receiver S. The low surface energy of release oil 73 provides a layer that is easily parted from toner T and receiver sheet S at nip N. This prevents toner T from offsetting to the surface of fuser roller 70.

As mentioned above, while release oil 73 is applied over the entire width of fuser roller 70, only that portion in contact with receiver sheet S is removed. Over time, release oil 73 will tend to build up at the portion of the surface area of fuser roller 70 that does not come in contact with the media. In conventional printing machines, larger-sized sheets of media that are printed after the release oil has built up on the fuser roller can be contaminated with the built-up release oil. This contamination can undesirably mark the printed output with image artifacts. In addition, if the printed sheet is to pass through duplexer 54 and again contact photoconductor 18 at transfer station 46, it has been observed that particulate contamination that is attracted to the release oil buildup can contaminate photoconductor 18, and thus the remainder of printing machine 10, resulting in further image artifacts and in an increased need for machine maintenance. Other image artifacts can also be caused by non-uniformity in the wear of rollers at fuser 49. For example, so-called "step-and-groove" image artifacts can be caused by the wear of the same location of fuser roller 70 from the repeated fusing of a large number of one size of receiver media, followed by the printing of larger-sized media and its fusing by both the worn and less worn portions of fuser roller 70. Other rollers at fuser 49, such as a downstream roller for imparting a glossy finish to the receiver media (or fuser roller 70 itself, which in some implementations can impart the glossy finish), can also wear non-uniformly when repeatedly applied to a large number of one size of media of a given size; this non-uniform wear can result in non-uniform glossy finishing as larger media is then printed and fused at fuser 49. According to this invention, the extent to which significant release oil buildup is transferred to printed sheets is minized, and the uniformity of wear at fuser roller 70 and other rollers at fuser 49 (e.g., a glossy finish roller) is improved, as will now be described in detail.

According to this preferred embodiment of the invention, LCU 24 controls the appropriate components of printing machine 10 to control registration station 45 to vary the corresponding position at which receiver sheet S contacts fuser roller 70. This position can vary from sheet to sheet, or vary after a selected number of sheets have been printed, may vary upon the selection of a different paper source or tray within printing machine, or in any other manner. By varying the position of even small receiver sheets S as they reach fuser roller 70, the next sheet or sheets S that pass through fuser 49 will overlap onto a portion of the surface of fuser roller 70 that still retains release oil from previous fusing operations; this next sheet or sheets will then remove the release oil at that overlapped portion. The continued varying of the position of sheets S along fuser roller 70 will continue to remove the release oil from the usable surface of fuser roller 70, preventing any significant buildup of release oil buildup at the usable surface of fuser roller 70. This greatly reduces the likelihood of image artifacts from the release oil itself, and from contaminating material that is attracted to and adheres to release oil buildup.

In printing machine 10 according to this preferred embodiment of the invention, as described above, the position of receiver sheet S at fuser 49 depends upon the positioning of receiver sheet S by registration station 45 to be in registration with the developed image on photoconductor 18 at transfer station 46. Therefore, according to this preferred embodiment of the invention, registration station 45 varies the varying position of receiver sheets S at transfer station 46 and therefore at fuser 49, which requires exposure station 34 to controllably vary the locations of photoconductor 18 at which the corresponding images defined.

Figure 4:
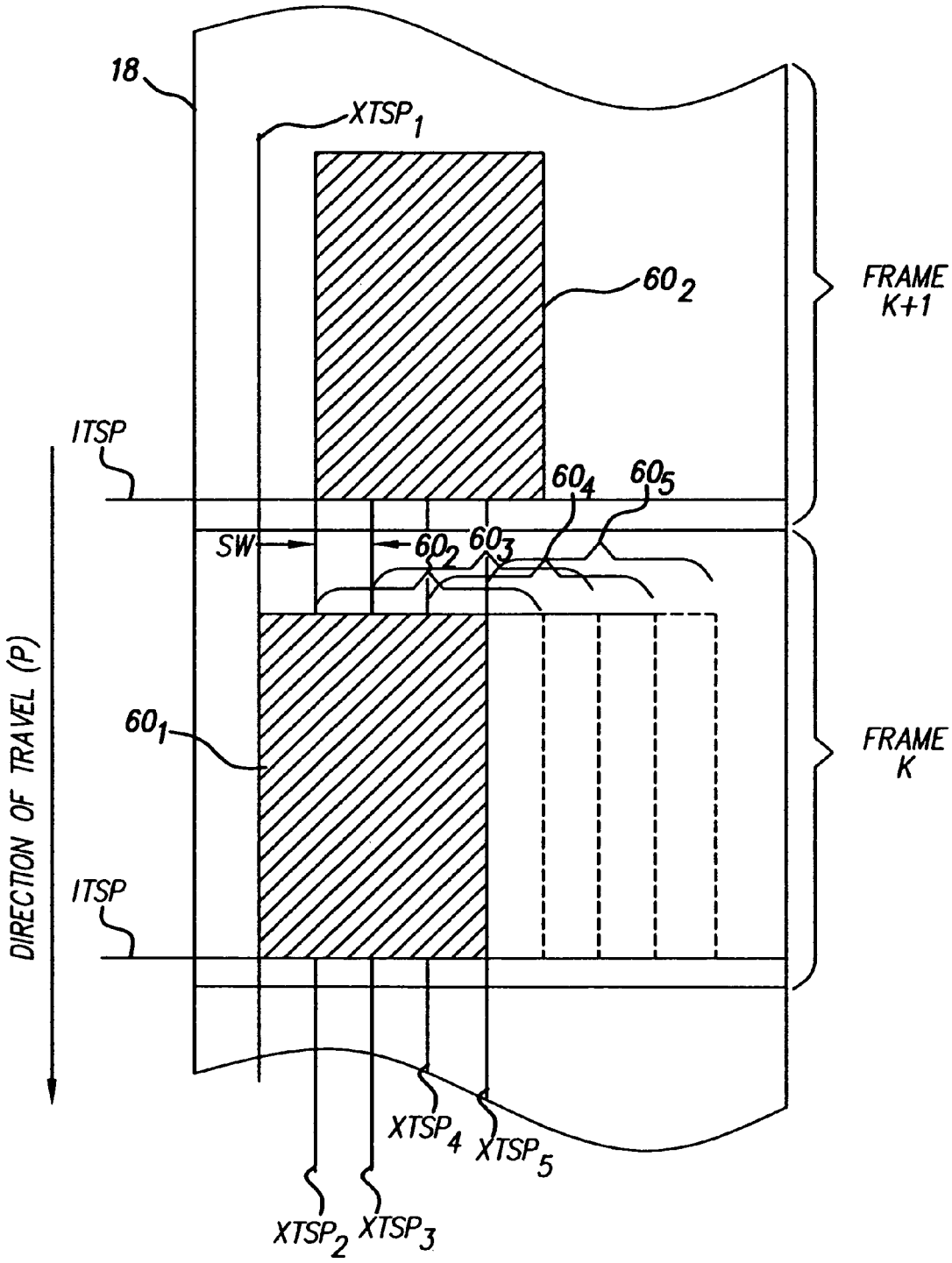
FIG. 4 is another view of a portion of a photoconductor as used in the printing machine of FIG. 1 according to the preferred embodiment of the invention.
Figure 5:
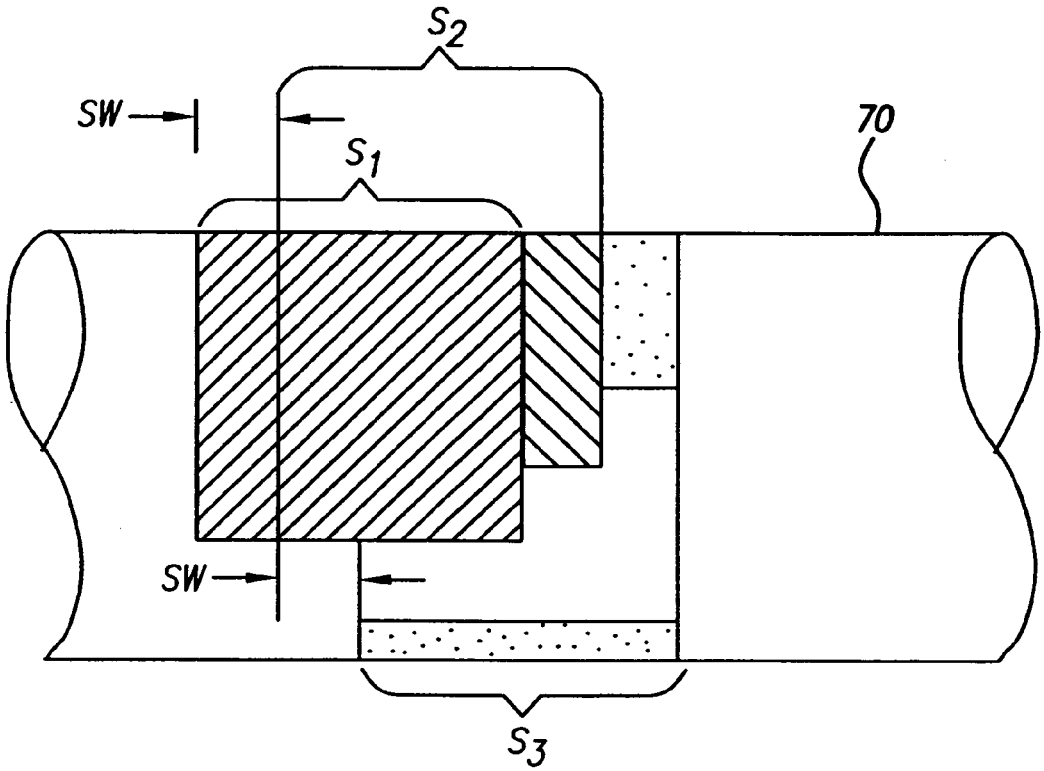
FIG. 5 is a view of a fuser roller as used in the printing machine of FIG. 1 according to the preferred embodiment of the invention.

FIGS. 4 and 5 illustrate an example of the preferred embodiment, with respect to the positioning of an image area on photoconductor 18 and the positioning of receiver sheet S at fuser roller 70, respectively. In FIG. 4, a portion of photoconductor 18 including two frames k, k+1 is shown. As discussed above, photoconductor 18 is preferably defined according to a continuous series of frames, each frame being a region of the surface of photoconductor 18 that receives a single image area 60, regardless of the size of image area 60. These frames of photoconductor 18 help maintain synchronization of the various functions within printing machine 10. Alternatively, the present invention may also be applied to a photoconductor belt or drum that is not arranged in frames.

As mentioned above relative to FIG. 2, a common in-track starting point ITSP is defined within each frame, at which the leading edge of image areas 60 is located. According to the preferred embodiment of the invention, the cross-track starting point XTSP varies over time. In this example, five possible cross-track starting points $XTSP_1$ through $XTSP_5$ are available, corresponding to image areas $\mathbf{60}_1$ through $\mathbf{60}_5$, respectively. The number of cross-track starting points XTSP will generally depend upon the size of the particular image area 60, relative to the usable width of photoconductor 18. Of course, smaller width image areas will provide more cross-track starting points across photoconductor 18. In any case, image area 60 corresponds to the possible locations at which exposure station 34 can affect the charge at the surface of photoconductor 18, to define the image to be printed on a receiver sheet S of the same size.

In the example of FIG. 4, a shift in the position of image areas 60 is illustrated between frame k and frame k+1. As mentioned above, the shift in position may occur after each sheet, and thus after each successive image; alternatively, the shift may occur after a selected number of images have been formed and receiver sheets printed. In this case, frame k is the last of a sequence of one or more frames in which the image is formed on photoconductor 18 at image area $\mathbf{60}_1$, having a cross-track starting point $XTSP_1$. Frame k+1 is the first of a sequence of one or more frames in which the image is formed on photoconductor 18 at image area $\mathbf{60}_2$, having a cross-track starting point $XTSP_2$. The position of image area $\mathbf{60}_2$ in frame k+1 is thus shifted by step width distance SW, relative to the position of image area $\mathbf{60}_1$ in frame k. This shifting in position will continue after each selected number of images, among the five defined image areas $\mathbf{60}_1$ through $\mathbf{60}_5$ in this example.

It is not necessary that the shift be incremental, from one image area $\mathbf{60}_1$ to the incrementally next image area $\mathbf{60}_2$. Rather, it may be preferred in some cases for the position to jump by more than a single increment. In one alternative implementation, the shift in position may take place only between two possible image areas 60, for example between the first image area $\mathbf{60}_1$ at the extreme left of photoconductor 18 (as viewed in FIG. 5) and the last image area $\mathbf{60}_5$ at the extreme right of photoconductor 18. It is contemplated that these and other alternatives will be apparent to those skilled in the art having reference to this specification.

The shifting of the image areas 60 on photoconductor 18 requires, in this embodiment of the invention, that the corresponding position of the media to be printed shift in a corresponding manner at transfer station 46, so that receiver sheet S will be in registration with the developed toner image. This will result, in the desired shifting of the cross-track position of receiver sheets S at fuser 49, reducing the buildup of release oil 73 on fuser roller 70. Accordingly, it is contemplated that registration station 45 in printing machine 10 according to this embodiment of the invention is controlled, for example by LCU 24, to place receiver sheets S at a selected position corresponding to image area 60 on photoconductor 18 as each frame passes transfer station 46, so that each receiver sheet S is aligned with the toner image pattern with which it is to be printed.

FIG. 5 illustrates a portion of fuser roller 70, illustrating the relative positioning of various receiver sheets $S_1$, $S_2$, $S_3$ at its surface, according to the preferred embodiment of the invention. In this example, receiver sheets $S_1$, $S_2$, $S_3$ correspond to image areas $\mathbf{60}_1$, $\mathbf{60}_2$, $\mathbf{60}_3$, respectively, and are thus shifted in the cross-track direction (i.e., parallel to the major axis of the cylinder of fuser roller 70) by shift width SW relative to one another (i.e., receiver sheet $S_3$ being shifted by a distance 2SW relative to receiver sheet $S_1$, of course). In this way, receiver sheets $S_1$, $S_2$, $S_3$ each contact a different portion of fuser roller 70, and thus serve to remove release oil from different locations of fuser roller 70, preventing buildup of the release oil at the surface. In addition, the varying positions of receiver sheets $S_1$, $S_2$, $S_3$, etc. will also more uniformly wear fuser roller 70, and any downstream rollers such as those used to apply a glossy finish to receiver sheets S, even if a large number of receiver sheets S of the same size are printed.

As shown in FIG. 5, the in-track position of receiver sheets $S_1$, $S_2$, $S_3$ also vary, despite each corresponding image area $\mathbf{60}_1$, $\mathbf{60}_2$, $\mathbf{60}_3$ beginning at the same in-track starting position ITSP, from frame to frame, on photoconductor 18. This is because the circumference of fuser roller 70 has no relationship to the length of receiver sheets S, and as such successive receiver sheets S, even if in the same cross-track position, will not start in the same in-track position (except in the remote chance that the length of sheet S and the circumference of fuser roller 70 are exact multiples of one another). In addition, FIG. 5 suggests that the (in-track) length of sheets S is less than the circumference of fuser roller 70. This suggestion is only for clarity of FIG. 5, because the circumference of fuser roller 70 will typically be much smaller than the length of any receiver sheet S, such that fuser roller 70 will make more than one revolution in fusing a given receiver sheet S.

Figure 6:
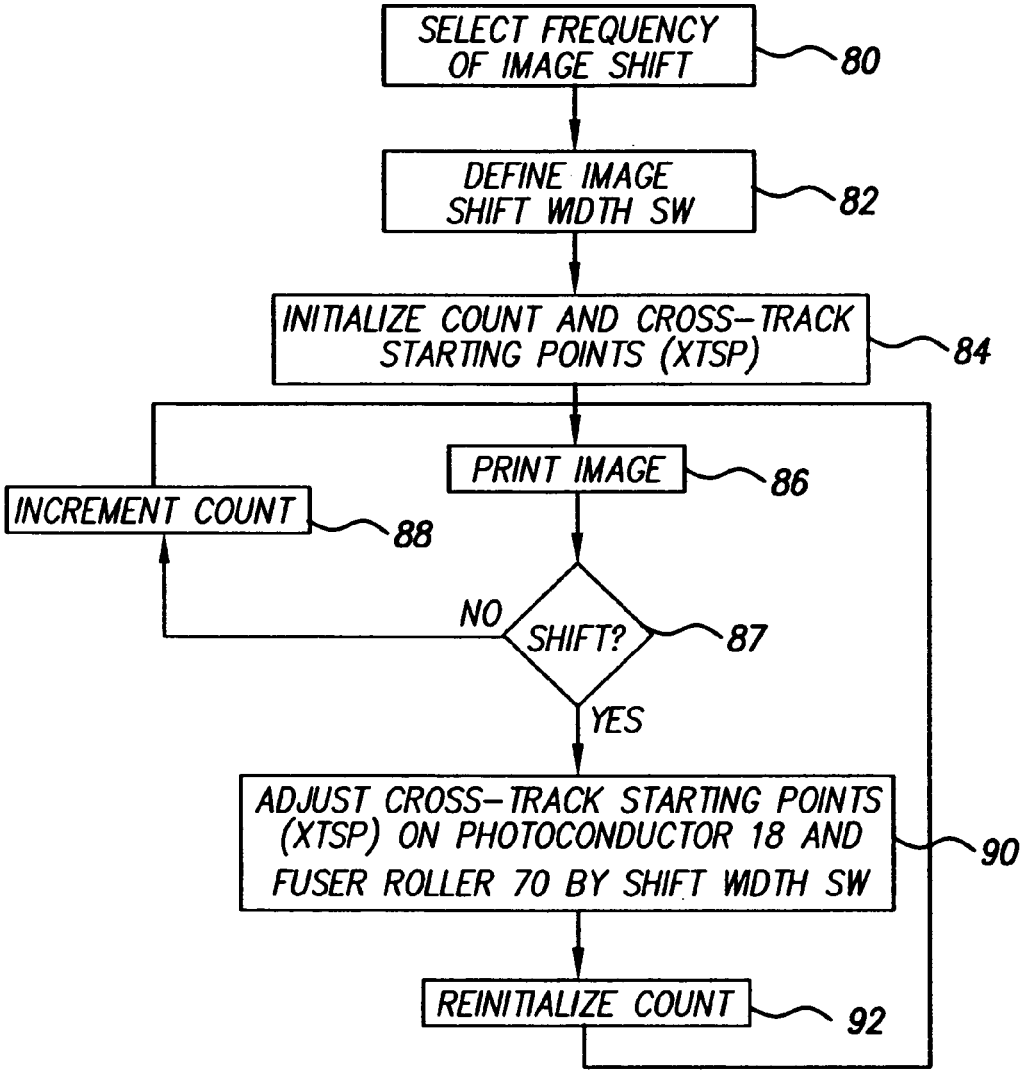
FIG. 6 is a flow chart illustrating a method of operating the printing machine of FIG. 1 according to the preferred embodiment of the invention.

Referring now to FIG. 6, the operation and control of printing machine 10 according to the preferred embodiment of the invention will now be described. In the exemplary embodiment of printing machine 10 illustrated in FIG. 1, it is contemplated that the control of printing machine 10 will be carried out by LCU 24, by its execution of computer program instructions. In this regard, it is contemplated that those skilled in the art having reference to this specification will be readily able to construct a software application including program instructions appropriate for the particular construction of LCU 24 or such other control circuitry or functionality within printing machine 10. It is further understood that the particular programmable circuitry or other control function for carrying out these program instructions may be included within a logic and control unit exemplified by LCU 24 in printing machine 10 of FIG. 1, or by way of a different implementation of the appropriate control circuitry, as will be understood by those skilled in the art.

The operation of printing machine 10 begins with process 80, in which LCU 24 defines the frequency at which the position of the image area on photoconductor 18 and the location at which receiver sheets S contact the surface of fuser roller 70 are both shifted. As mentioned above, this frequency of this position shift may be as frequent as every sheet. However, it is contemplated that a lower frequency will also be sufficient to prevent significant buildup of release oil at the surface of fuser roller 70. For example, the position may be shifted after fifty sheets, or at each time that a paper supply drawer is emptied or changed. In any event, in process 80, LCU 24 can set this shift frequency in response to an input from the user or installer of printing machine 10, or by reading a default value from memory.

In process 82, LCU 24 defines shift width SW, which corresponds to the distance that successive image areas 60 on photoconductor 18 and receiver sheet S position at fuser roller 70 are shifted. As described above, the shift may be of a single increment from one position to the next in the cross-track direction, or instead the shift may be much larger, for example by shifting from one extreme position to the other, or by more than one increment, as the case may be. The shift width SW may be selected by a user or installer of printing machine 10, or alternatively shift width SW may be calculated by LCU 24 or another computer function within printer machine 10, for example in response to the cross-track width of the printed image relative to the usable widths of photoconductor 18 and fuser roller 70.

In process 84, LCU 24 initializes a page count index, for use in determining when to shift the image area and sheet position, and initializes cross-track starting points at photoconductor 18 and fuser roller 70. In printing machine 10 according to this embodiment of the invention, the initializing or setting of image area 60 on photoconductor 18 is preferably performed by controlling the location of photoconductor 18 at which exposure station 34 will operate. It is contemplated that this control will be accomplished digitally, for example by controlling the starting and stopping positions at which the LEDs or laser (or other light source) will be irradiating photoconductor 18 to form the image pattern. It is further contemplated that the initializing or setting of the position of fuser roller 70 to be contacted by receiver sheets S will typically be effected at registration station 45 of printing machine 10, specifically by controlling the cross-track position at which each receiver sheet S contacts photoconductor 18 at transfer station 46 to receive the toner pattern, thus in turn defining the position of fuser roller 70 contacted by receiver sheet S.

Other approaches to controlling the position of fuser roller 70 contacted by receiver sheets S are also contemplated. For example, a downstream mechanical positioner may be inserted between transfer station 46 and fuser 49, to shift the position of receiver sheet S in the cross-track direction to the desired location. In this case, there need not be any shift in the cross-track position of image areas 60 on photoconductor 18, so long as varying of the position of the receiver sheet S at fuser roller 70 is accomplished. It is contemplated that this approach involves additional mechanical components and control, however, specifically by requiring a controllable positioner between transfer station 46 and fuser 49, in addition to registration station 45.

Referring back to FIG. 6, printing of an image onto a receiver sheet S is now carried out by printing machine 10, in process 86. Printing process 86 is contemplated to subsume the writing of photoconductor 18 at exposure station 34, the developing of the charge pattern with toner at developer station 38, the registration of receiver sheet S at registration station 45, the transferring of the toner to receiver sheet S at transfer station 46, and the fusing of the toner to receiver sheet at fuser 49. Furthermore, as is conventional in the art, the overall printing process is "pipelined" in the sense that multiple page images are in various stages of the overall printing process at any given time. LCU 24 synchronizes printing machine 10, including the positioning and registration of the various image and receiver sheet positions, for all of the images that are in the process of being printed at each point in time.

Following the printing of an image, LCU 24 executes decision 87, to determine whether the cross-track position is to be shifted by the shift width SW. It is contemplated that decision 87 will be carried out by comparing the current value of the count index initialized in process 64 against a limit corresponding to the desired shift frequency set in process 80. However, as mentioned above, other criteria may be used to effect shift decision 87, for example by determining whether a different paper source is to be used for the next receiver sheet S. In any case, if no position shift is desired at this time (decision 87 is NO), the count index (if used) is incremented in process 88, and the next image is printed in process 86.

In the event that a position shift is desired (decision 87 is YES), LCU 24 executes process 90 to adjust the cross-track starting point XTSP at both photoconductor 18 and fuser roller 70, by the shift width SW defined in process 82. As noted above, in this preferred embodiment of the invention, this adjustment of process 90 will be accomplished by LCU 24 controlling exposure station 34 to define the corresponding location of the image area on photoconductor 18, and by LCU 24 controlling registration station 45 to define the corresponding position at which receiver sheet S is applied to photoconductor 18 at transfer station 46, and accordingly the position of receiver sheet S as it contacts fuser roller 70. Alternatively, as mentioned above, if a positioning mechanism is in place between transfer station 46 and fuser 49, the image area need not be adjusted at exposure station 34, as this positioning mechanism will shift receiver sheets S to the desired location. Following the shift of process 90, the count index (if used) is again initialized, and control passes back to process 86 in which the next image will be printed.

The printing process continues through this loop, with the cross-track position of the receiver sheets S at fuser roller 70 varying in the desired manner. This change in position at fuser roller 70 removes excess buildup of release oil from fuser roller 70 during the printing process, eliminating image artifacts due to this excess release oil attaching to subsequent printed sheets, and reducing the contamination and additional image artifacts that can be caused by sheets having this excess release oil being fed through printing machine 10 again during duplex printing. In addition, the varying of the position of receiver sheets S also prevents the concentration of wear of fuser roller 70, and also prevents the concentration of wear at other rollers such as a glossy finish roller, making more uniform the wear on these rollers and thus reducing the degree of step-and-groove wear and the corresponding image artifacts. As a result of this invention, therefore, the quality of printed output is greatly improved, as is the overall internal cleanliness of the printing machine itself, resulting in reduced maintenance costs and longer machine life.

It is contemplated that many alternative implementations of this invention will be apparent to those skilled in the art having reference to this specification. As noted above, one such alternative implementation is to include a positioning mechanism after transfer and before fusing, in which case shifting of the image area at the photoconductor is not necessary. Further in the alternative, in some printers the toner pattern is fused at the time of transfer, so that separate fuser and transfer stations are not provided; in this case, shifting of the cross-track position of the receiver sheet media at the transfer/fuser station in a manner corresponding to shifted image area positions on the photoconductor can be used. It is contemplated that these and other alternative implementations are within the scope of this invention as claimed.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of operating an electrographic printing machine, comprising:

transferring toner to a first receiver sheet of a first size, the transferred toner being in a pattern corresponding to an image to be printed on the first receiver sheet;

placing the first receiver sheet in contact with the surface of a fuser roller at a first position, to fuse the transferred toner to the first receiver sheet;

then transferring toner to a second receiver sheet also of the first size, the transferred toner being in a pattern corresponding to an image to be printed on the second receiver sheet;

placing the second receiver sheet in contact with the surface of the fuser roller at a second position, to fuse the transferred toner to the second receiver sheet;

repeating the transferring toner and placing steps for a plurality of receiver sheets that are also of the first size;

wherein the placing step places each successive receiver sheet in contact with the surface of the fuser roller at a different position that of a preceding receiver sheet.

2. The method of claim 1, wherein the first and second positions of the surface of the fuser roller correspond to first and second cross-track starting points, respectively, along the surface of the fuser roller in a direction parallel with a major axis of the fuser roller.

3. The method of claim 1, wherein the transferring steps comprise:

adhering toner to a selected portion of a photoconductor in a pattern corresponding to the image pattern to be printed; and placing the receiver sheet in contact with the selected portion of the photoconductor in such a manner that the toner transfers from the selected portion of the photoconductor to the receiver sheet.

4. The method of claim 3, wherein the adhering step comprises:

charging at least the selected portion of a photoconductor;

modifying the charge at selected locations of the selected portion of the photoconductor according to the image to be printed; and placing toner in proximity to the selected portion of the photoconductor, so that the toner is electrostatically attracted to the selected portion of the photoconductor in a pattern corresponding to the image to be printed.

5. The method of claim 4, wherein the photoconductor is a belt.

6. The method of claim 4, wherein, for the image to be printed on the first receiver sheet, the modifying step is performed at a selected portion of the photoconductor at a first cross-track position of the photoconductor;

and wherein, for the image to be printed on the second receiver sheet, the modifying step is performed at a selected portion of the photoconductor at a second cross-track position of the photoconductor.

7. The method of claim 6, wherein the first and second positions of the surface of the fuser roller correspond to first and second cross-track starting points, respectively, along the surface of the fuser roller in a direction parallel with a major axis of the fuser roller.

8. The method of claim 7, wherein, for the first receiver sheet, the placing step places the first receiver sheet in contact with the selected portion of the photoconductor at the first cross-track position of the photoconductor;

and wherein, for the second receiver sheet, the placing step places the second receiver sheet in contact with the selected portion of the photoconductor at the second cross-track position of the photoconductor.

9. The method of claim 1, further comprising:

applying a release oil to a surface of the fuser roller.

10. The method of claim 9, wherein the step of applying a release oil is performed substantially continuously.

11. The method of claim 1, wherein the step of placing the first receiver sheet comprises:

prior to the step of transferring toner to the first receiver sheet, controlling a registration station to position the first receiver sheet at a first cross-track position;

then feeding the first receiver sheet at the first cross-track position to a transfer station; and after the step of transferring toner to the first receiver sheet, feeding the first receiver sheet at the first cross-track position to the first position at the fuser roller;

and wherein the step of placing the second receiver sheet comprises:

prior to the step of transferring toner to the second receiver sheet, controlling the registration station to position the second receiver sheet at a second cross-track position;

then feeding the second receiver sheet at the second cross-track position to the transfer station; and after the step of transferring toner to the second receiver sheet, feeding the second receiver sheet at the second cross-track position to the second position at the fuser roller.

12. A method of operating an electrographic printing machine, comprising:

transferring toner to a first receiver sheet of a first size, the transferred toner being in a pattern corresponding to an image to be printed on the first receiver sheet;

placing the first receiver sheet in contact with the surface of a fuser roller at a first position, to fuse the transferred toner to the first receiver sheet;

then transferring toner to a second receiver sheet also of the first size, the transferred toner being in a pattern corresponding to an image to be printed on the second receiver sheet;

placing the second receiver sheet in contact with the surface of the fuser roller at a second position, to fuse the transferred toner to the second receiver sheet;

wherein the first receiver sheet is one of a first plurality of receiver sheets of the first size and the second receiver sheet is one of a second plurality of receiver sheets of the first size;

wherein each of the first plurality of receiver sheets are printed in successive sequence, with the placing step placing each successive receiver sheet of the first plurality of receiver sheets in contact with the surface of the fuser roller at the first position; and wherein each of the second plurality of receiver sheets are printed in successive sequence, with the placing step placing each successive receiver sheet of the second plurality of receiver sheets in contact with the surface of the fuser roller at the second position.

13. The method of claim 12, further comprising:

changing the position at which the placing step places each receiver sheet from the first position to the second position responsive to printing a selected number of receiver sheets in the first plurality of receiver sheets.

14. The method of claim 12, further comprising:

changing the position at which the placing step places each receiver sheet from the first position to the second position responsive to changing from a first paper supply to a second paper supply.

15. A printing machine, comprising:

a photoconductor;

an exposure station, for effecting a charge pattern at a portion of the photoconductor, the charge pattern corresponding to an image to be printed;

a developer station, for electrostatically adhering toner to the photoconductor in a toner pattern corresponding to the charge pattern effected by the exposure station;

a transfer station, for transferring toner in the toner pattern from the photoconductor to a receiver sheet; and a fuser station, comprising a fuser roller, for applying pressure to the receiver sheet so that the toner fuses to the receiver sheet in the toner pattern; and a control function, for controlling the position of receiver sheets at the surface of the fuser roller, the control function programmed so that a first receiver sheet of a first size contacts the fuser roller at a first cross-track position, and so that a second receiver sheet of the first size contacts the fuser roller at a second cross-track position such that each successive receiver sheet in contact with the surface of the fuser roller at a different position that of a preceding receiver sheet.

16. The printing machine of claim 15, wherein the transfer station transfers toner from the photoconductor to a receiver sheet by placing the receiver sheet in proximity to the portion of the photoconductor bearing the toner pattern.

17. The printing machine of claim 16, further comprising:

a registration station, for controlling the positioning of receiver sheets at the transfer station;

wherein the control function controls the position of receiver sheets at the surface of the fuser roller by controlling the exposure station to effect the charge pattern corresponding to the image to be printed in an image area beginning at a selected cross-track position of the photoconductor, and by controlling the registration station to place the receiver sheet at the transfer station in proximity to the portion of the photoconductor bearing the toner pattern at a selected cross-track position of the photoconductor.

18. The printing machine of claim 15, wherein the control function comprises a programmable control and logic unit.

19. The printing machine of claim 18, wherein the programmable control and logic unit is programmed to control the exposure station and registration station to select a first cross-track position for a selected number of receiver sheets, and to select a second cross-track position for a selected number of receiver sheets.

20. The printing machine of claim 18, wherein the programmable control and logic unit is programmed to change the selected cross-track positions responsive to a change in supply of the receiver sheets.

21. The printing machine of claim 15, wherein the fuser station further comprises:

a release oil supply, for applying a film of release oil to the surface of the fuser roller.

22. The printing machine of claim 21, wherein the fuser station further comprises:

a heater for heating the fuser roller.

23. The printing machine of claim 21, wherein the fuser station further comprises:

a pressure roller, opposing and contacting the fuser roller at a nip location through which the receiver sheet passes to fuse the toner thereto.

24. A printing machine, comprising:

a photoconductor;

an exposure station, for effecting a charge pattern at a portion of the photoconductor, the charge pattern corresponding to an image to be printed;

a developer station, for electrostatically adhering toner to the photoconductor in a toner pattern corresponding to the charge pattern effected by the exposure station;

a transfer station, for transferring toner in the toner pattern from the photoconductor to a receiver sheet wherein the transfer station transfers toner from the photoconductor to a receiver sheet by placing the receiver sheet in proximity to the portion of the photoconductor bearing the toner pattern; and a fuser station, comprising a fuser roller, for applying pressure to the receiver sheet so that the toner fuses to the receiver sheet in the toner pattern; and a programmable control and logic unit control function, for controlling the position of receiver sheets at the surface of the fuser roller, the control function programmed so that a first receiver sheet of a first size contacts the fuser roller at a first cross-track position, and so that a second receiver sheet of the first size contacts the fuser roller at a second cross-track position a registration station, for controlling the positioning of receiver sheets at the transfer station;

wherein the programmable control and logic unit control function controls the position of receiver sheets at the surface of the fuser roller by controlling the exposure station to effect the charge pattern corresponding to the image to be printed in an image area beginning at a selected cross-track position of the photoconductor, and by controlling the registration station to place the receiver sheet at the transfer station in proximity to the portion of the photoconductor bearing the toner pattern at a selected cross-track position of the photoconductor; and capable of changing the selected cross-track positions in response to a change in supply of receiver sheets.

25. The printing machine of claim 24, wherein the programmable control and logic unit is programmed to control the exposure station and registration station to select a first cross-track position for a selected number of receiver sheets, and to select a second cross-track position for a selected number of receiver sheets.

* * * * *